United States Patent [19]

Knight

[11] Patent Number: 4,458,122

[45] Date of Patent: Jul. 3, 1984

[54] CAM SWITCH MECHANISM AND CONTROL DEVICE, SUCH AS A PULLKEY, INCORPORATING THE SAME

[75] Inventor: Peter D. Knight, Nottingham, England

[73] Assignee: Communication and Control Engineering Company Limited, Nottingham, England

[21] Appl. No.: 467,980

[22] Filed: Feb. 18, 1983

[30] Foreign Application Priority Data

Feb. 19, 1982 [GB] United Kingdom ..... 8204989

[51] Int. Cl.[3] ..... H01H 17/06

[52] U.S. Cl. ..... 200/153 LA; 200/161

[58] Field of Search ..... 200/153 LA, 153 T, 161, 200/153 F, 18

[56] References Cited

U.S. PATENT DOCUMENTS 3,676,625 7/1972 Blatt ..... 200/153 LA
4,181,838 1/1980 Neuser et al. ..... 200/153 LA

FOREIGN PATENT DOCUMENTS 1251451 12/1960 France ..... 200/153 T
937229 9/1963 United Kingdom .
2077472 12/1981 United Kingdom .
2094557 9/1982 United Kingdom ..... 200/161

*Primary Examiner*—John W. Shepperd
*Assistant Examiner*—Renee S. Kidorf
*Attorney, Agent, or Firm*—Seidel, Gonda & Goldhammer

[57] ABSTRACT

The cam switch mechanism which is particularly appropriate for use in a pullkey where one must be able to initiate two separate switching operations, i.e. lockout and signal, enables a pull on a wire at either end of the unit to trigger a first response, e.g. lockout, but still permits further pulls on the wire to trigger repeated second responses, e.g. signal. First and second microswitches are actuated via independent cam followers whose movement is controlled by linear sliding cams connected respectively to the pullwires at opposite ends of the unit. Each cam comprises two parallel cam plates with the four plates interleaved so that recessed zones in the plates control movement of the cam followers. A manually controllable actuator, such as a lockout knob, may be provided to actuate the first microswitch independently of the movement of the linear cams without inhibiting subsequent sliding movement of the linear cams. In the case of a latching pullkey the lockout knob has pins projecting into holes in the linear cams so that relative movement of the cams automatically causes mechanical latching of the lockout knob in a position in which it can only be reset manually. For a non-latching pullkey the pins are omitted.

21 Claims, 14 Drawing Figures

FIG.8.
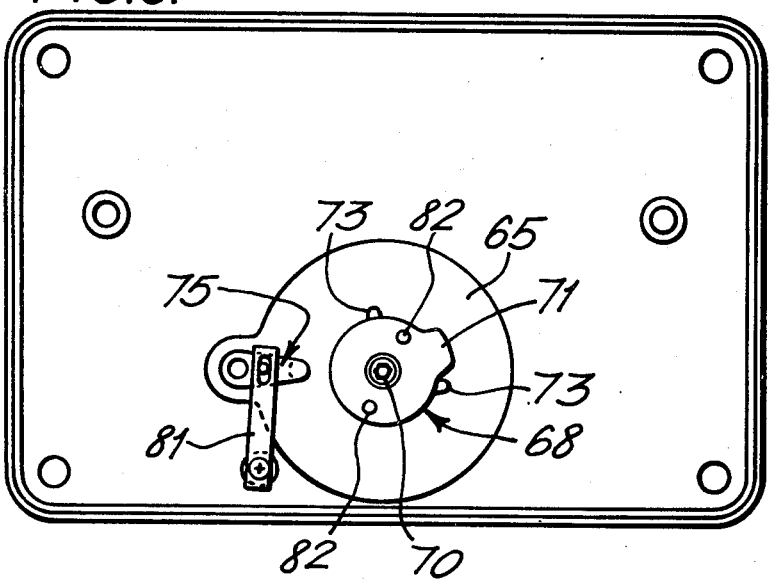
FIG.10.
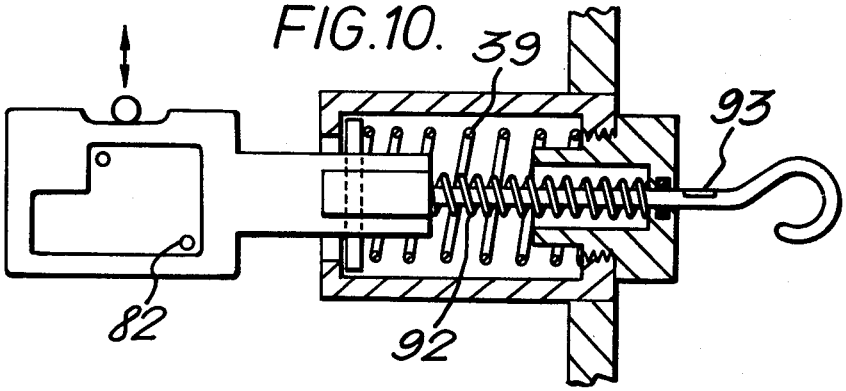
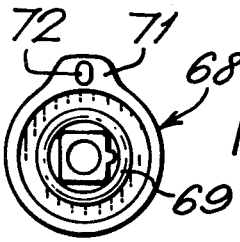
FIG.9.

CAM SWITCH MECHANISM AND CONTROL DEVICE, SUCH AS A PULLKEY, INCORPORATING THE SAME

BACKGROUND

This invention relates to a cam switch mechanism, and to control devices which incorporate this mechanism and which are thereby able to control a wide range of different types of apparatus and systems. The invention is particularly concerned with a pullkey, which is one such control device incorporating this cam switch mechanism.

Although the cam switch mechanism is described hereinafter in relation to a pullkey, it should be understood that the cam switch mechanism in its broadest aspects is not limited to this particular application. Nevertheless, the invention is particularly concerned with pullkeys, and with a pullkey which is simple to operate, has a direct on-line switching action, can be produced relatively easily and cheaply, is attractive in appearance, has a low profile for unobtrusive mounting, and is capable of use in a variety of different operational systems.

Pullkeys are designed for use in particular alongside conveyors and other mechanised equipment where safe protection and emergency stopping of the conveyor or other machinery is required. For example, pullkeys are used in conjunction with conveyors and other systems operating at coal faces, alongside roadways, and in various industrial applications. Pullkeys are usually mounted alongside or adjacent to the conveyor or other machinery at intervals, depending upon site requirements, with a single-ended type pullkey at each end of the line and with a number of double-ended pullkeys spaced in between. It is important for such pullkeys that they should have a positive, reliable switch action. The switch mechanism within the pullkey must be able to perform at least two functions. Firstly, in response to a pull on the interconnecting pullwire or pull-rods the switch mechanism must initiate lockout, i.e. produce a positive and effective stopping of the associated conveyor or other equipment. Secondly, the switch mechanism must be able to provide for signalling, i.e. to provide a remote indication that a particular pullkey has been actuated and to enable further pulls on the pullwire to signal or trigger an alarm. In operation, pulling of the pullwire will operate the switch mechanism which will both initiate the lockout action and also produce a signal indication. Pullkeys conventionally also incorporate a lockout knob. In latching type pullkeys the lockout knob is actuated automatically when the pullwire is pulled, and the lockout knob and the system can only be reset by a positive manual resetting operation at the pullkey itself. In non-latching type pullkeys the lockout knob is not actuated automatically and can only be actuated locally by a manual rotation of the knob at the pullkey itself. Electrical lockout initiated by a pull on the wire in the case of a non-latching pullkey is not linked to a rotation of the lockout knob which would give mechanical latching and prevent remote resetting of the system. The pull on the wire just switches a relay or contactor to stop the system, and resetting can be carried out at the central control unit, not at the pullkey.

DESCRIPTION OF THE PRIOR ART

One known control device which can be incorporated in a pullkey is described in British patent specification No. 1473497. This control device comprises two cams, a signal cam and a lockout cam, which are mounted coaxially on a cam shaft for rotation with the shaft about the shaft axis. Associated with the cams are cam-follower rollers, coupled to actuating arms which form part of respective microswitches. Pullwires extending to each side of the pullkey are secured to plungers which move perpendicularly to the camshaft axis and cause rotation of the camshaft through striking an intermediate plate secured to the camshaft. The pullwires extend fore and aft respectively of the camshaft. Additionally, the lockout knob, which is used for resetting the device, is integral with the lockout cam. This known device, besides being relatively complex in terms of components and their linked motion, also lacks flexibility in terms of what responses one can get from the device. Furthermore, in this known device one is first having to convert linear motion of the pullwire into a rotary motion before initiating a switching action at the microswitches.

SUMMARY OF THE INVENTION

It is an object of the present invention to provide a cam switch mechanism, and a control device, in which there is the capacity to initiate two separate switching operations, in the case of a pullkey these being lockout and signal. For a latching type pullkey the mechanism should be such that one of the switch responses, i.e. lockout, initiates an automatic, only manually reversible reaction, whereas the other switch response, i.e. signal, can be triggered repeatedly even after initiation of said one response.

A switch mechanism which can perform such a dual function whereby an input to the mechanism will trigger a first response but still permit subsequent inputs to the switch mechanism to trigger a second, different response is capable of widespread application to all manner of control situations.

In accordance with one aspect of the present invention, there is provided a switch mechanism comprising first switch means, second switch means, two cam members which are slidable linearly relative to each other in side-by-side relationship and which each have first and second cam surfaces, a first cam follower engageable by said two first cam surfaces and displaceable upon relative sliding movements of the cam members to actuate said first switch means, and a second cam follower engageable by said two second cam surfaces and displaceable independently of said first cam follower upon the said relative sliding movement of the cam members to actuate said second switch means, wherein actuation of said first switch means to generate a first output response does not prevent repeated actuation of said second switch means by said second cam surfaces in response to repeated relative sliding movement of the cam members.

Preferably the cam members each comprise two parallel cam plates with for each cam member one plate defining one of said first cam surfaces and the other plate defining one of said second cam surfaces, the four plates being interleaved so that said one plates are positioned adjacent to each other and said other plates are positioned adjacent to each other.

In the case of a pullkey the first and second cam surfaces would initiate lockout and signal in a predetermined sequence. The two cam members can be identical.

In accordance with another aspect of the invention there is provided a switch mechanism comprising first switch means arranged to initiate a first output response, a second switch means arranged to initiate a second output response, first and second cam members mounted for linear relative sliding movement, each cam member defining a first cam surface which controls actuation of said first switch means and a second cam surface which controls actuation of said second switch means, and a manually controllable actuator capable of actuating said first switch means independently of the movement of said cam members without inhibiting subsequent relative sliding movement of the cam members.

In a preferred embodiment of this switch mechanism, as in a latching type pullkey, each of the cam members defines a third cam surface and, upon a relative sliding movement of the cam members sufficient for one of said first cam surfaces to actuate said first switch means, the corresponding one of said third cam surfaces moves said manually controllable actuator to a position in which it can only be reset manually.

Preferably, the cam members are hollow cams, with the first and second cam surfaces being formed in the external contour and with the third cam surface being formed by the internal contour. The two cam members can be identical.

Also in accordance with the present invention there is provided a pullkey incorporating any of the aforesaid switch mechanisms. In the case of a pullkey, the said first switch means initiates a lockout output and the said second switch means initiates a signal output. The manually controllable actuator is a lockout knob.

In the case of a latching pullkey the lockout knob may be provided with its own cam surface to actuate the said first switch means and also has pins projecting into holes formed in the cam members whereby movement of one of the cam members causes rotation of the knob to a locked out position.

Each cam member may comprise a pair of substantially rectangular plates arranged parallel to each other with each plate having a recess in the outer periphery, for co-operation with a cam follower. One plate, e.g. a signal cam plate, has a rectangular hole therethrough, while the other plate, e.g. a lockout cam plate, has an L-shaped hole therethrough in overlying relationship to the rectangular hole. The projecting corner of the said other plate defines the cam surface which rotates the lockout knob in the case of a latching pullkey.

BRIEF DESCRIPTION OF THE DRAWINGS

The invention will now be described with reference to a number of presently preferred embodiments which are described by way of example and with reference to the accompanying drawings. The switch mechanism of the present invention is described embodied in various types of pullkey, these pullkeys also being a part of the inventive concept of the present invention. In the drawings:

FIG. 8 is a rear view, from inside the pullkey, showing the rotary lockout knob cam;

FIG. 9 is a front view of the rotary lockout knob cam shown in FIG. 8; and,

FIG. 10 shows a modified arrangement for incorporation within a pullkey which is designed to operate in a tensioned wire system.

DESCRIPTION OF THE PREFERRED EMBODIMENTS

Figure 1B:
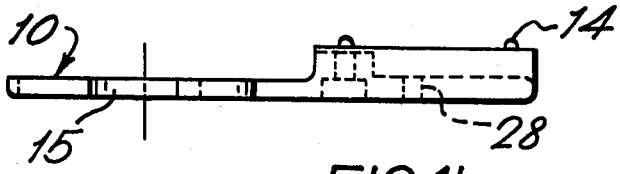
FIG. 1*b* is a top plan view of the lockout cam plate of FIG. 1*a;*
Figure 1A:
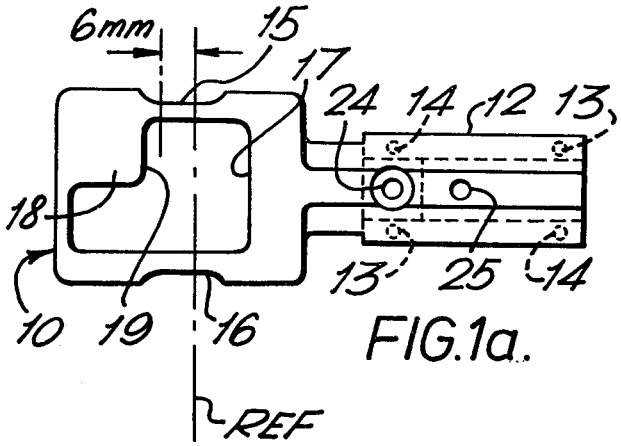
FIG. 1*a* is a side view of one half of one cam member of the switch mechanism, this constituting a lockout cam plate.
Figure 1C:
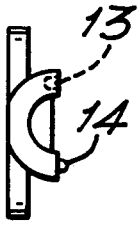
FIG. 1*c* is an end elevation of the lockout cam plate of FIG. 1*a;*
Figure 2B:
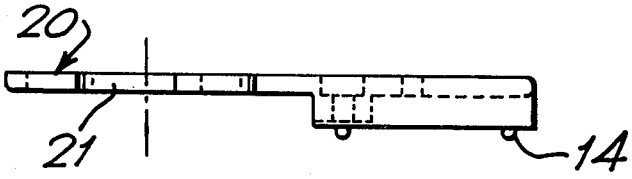
FIG. 2*b* is a top plan view of the signal cam plate of FIG. 2*a;*
Figure 2A:
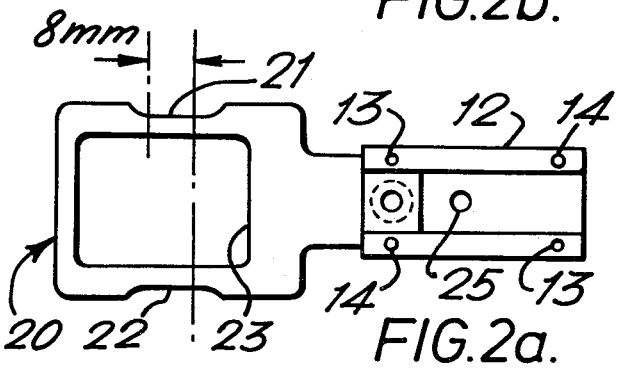
FIG. 2*a* is a side view of the other half of said cam member of the switch mechanism, this constituting a signal cam plate.
Figure 2C:
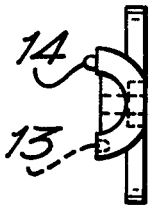
FIG. 2*c* is an end elevation of the signal cam plate of FIG. 2*a;*

Referring first to FIGS. 1 and 2, these show respectively the two halves of one cam member which forms an essential part of the novel switch mechanism which is part of the pullkey of the present invention. The cam plate 10 shown in FIGS. 1*a*, 1*b* and 1*c* constitutes a lockout cam plate and comprises a generally rectangular plate which is provided with an extension portion 12 from one of its shorter sides. This extension portion 12 is semi-circular in cross-section, as shown in FIG. 1*c*, and is provided with location holes 13 and location pins 14 which match corresponding holes and pins in and on the equivalent semi-circular cross-section portion of the other cam plate shown in FIGS. 2*a*, 2*b* and 2*c*. The lockout cam plate 10 is provided with a recess 15 in its upper longitudinal edge, and with an equal length recess 16 in its lower longitudinal edge. The cam plate 10 is provided with a central hole 17 therethrough. This hole 17 is substantially L-shaped, as shown in FIG. 1*a*, thus defining an inwardly projecting corner piece 18 which has an abutment surface 19.

The other cam plate 20, shown in FIGS. 2*a*, 2*b* and 2*c*, constitutes a signal cam plate. It again is generally rectangular in shape and has an extension portion 12 extending from one side edge. The signal cam plate 20 is provided with a recess 21 in its upper longitudinal edge and with an equal length recess 22 in its lower longitudinal edge. As will be explained later, these recesses 21 and 22 need not be the same length as the recesses 15 and 16 in the edges of the lockout cam plate 10. The signal cam plate 20 is also provided with a central hole 23 therethrough. In contrast to the hole in the lockout cam plate 10, the hole 23 in the signal cam plate is rectangular in shape.

As will be appreciated from FIGS. 1 and 2, the positions of the holes 17 and 23 in the cam plates and the positions of the recesses 15, 16, 21, 22 are determined with reference to a line REF. The cam plates can suitably be made of a zinc alloy material.

The signal cam plate 20 and the lockout cam plate 10 are fastened together to make a cam member by the interengagement of the locating pins and holes and by the provision of a fastening bolt 24. The two semi-circular cross-section extention portions 12 then define a tube which is capable of retaining the end of a wire shackle which is provided with an eyelet for attachment to a pullwire or pullrod. A tension pin or other securing means passes through the tube at the inner end of the shackle wire and through a hole 25 in the two cam plates 10 and 20.

Figure 3:
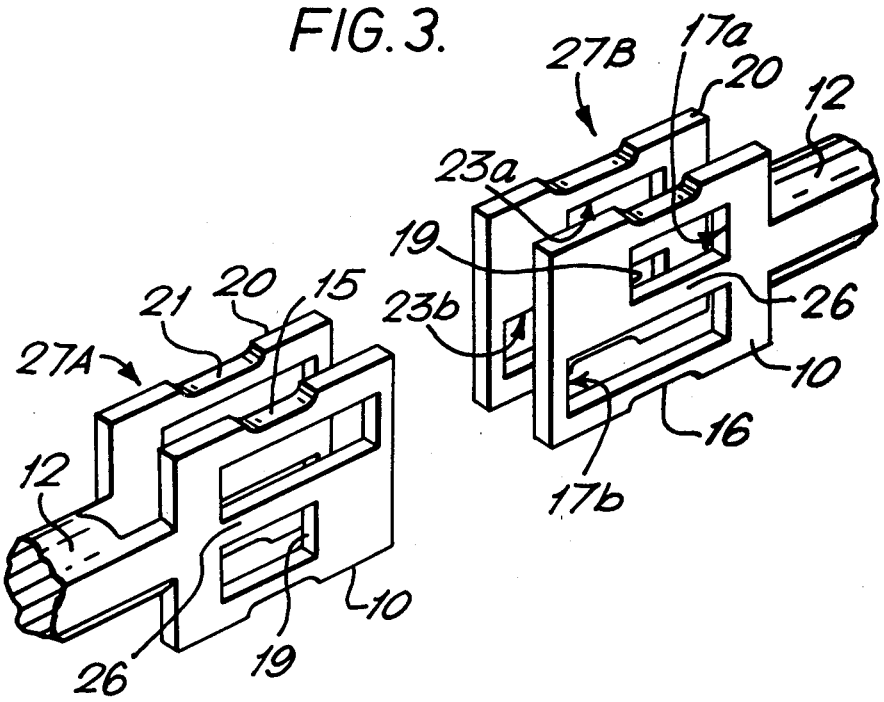
FIG. 3 is a view illustrating how two cam members, each comprising a lockout cam plate and a signal cam plate, are interleaved in the mechanism of the present invention, these two cam members having slightly different cam plates as compared with FIGS. 1 and 2.

The individual cam plates shown in FIG. 3 and similarly identified by references 10 and 20 differ slightly from the cam plates of FIGS. 1 and 2. The holes 17 and 23 are subdivided each into two holes separated by a bar 26. The two holes in the lockout cam plates 10 are indicated at 17*a* and 17*b*, and the two holes in the signal cam plates 20 at 23*a* and 23*b*. The lengths of the pairs of recesses 15, 16 and 21, 22, as before, may be the same or different. Here, the signal cam plate recesses 21, 22 are shown slightly longer than the lockout cam plate recesses 15, 16. Also instead of the two cam plates 10, 20 of each cam member being secured together by a bolt 24, they are secured by an adhesive.

Figure 6:
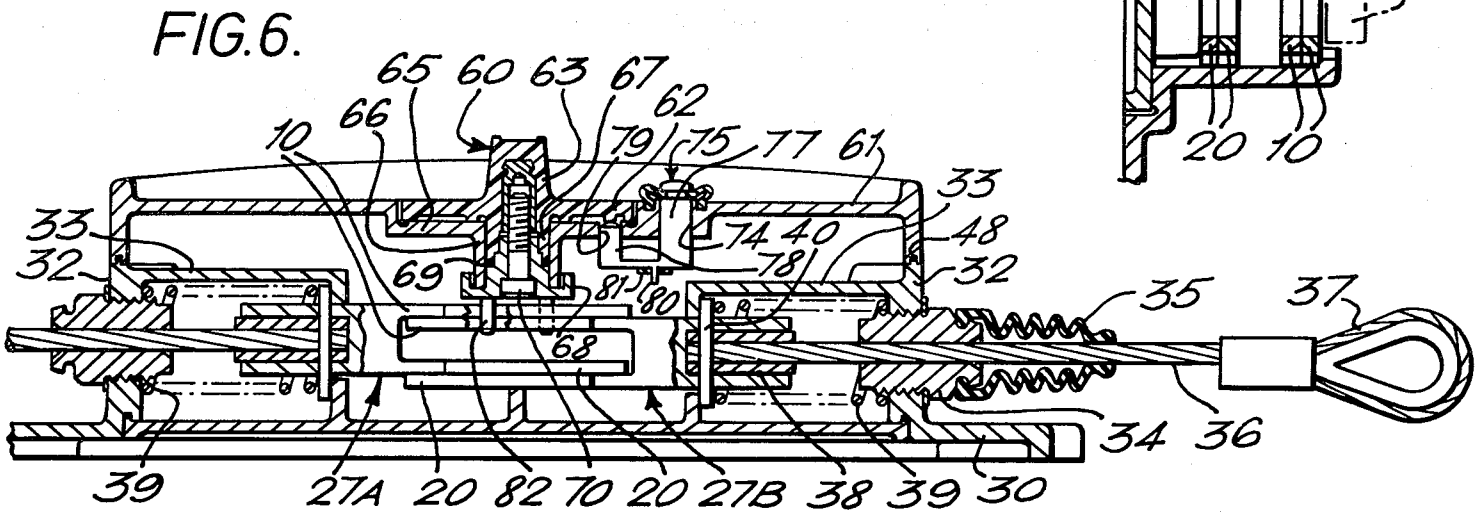
FIG. 6 is a sectional view through the pullkey, taken along the line VI—VI in FIG. 5.

As is shown in FIGS. 3 and 6, two identical cam members 27A and 27B, each comprising a pair of cam plates 10 and 20, are provided in the illustrated double-ended pullkey. The two cam members are mounted so as to be slidable relative to one another longitudinally along the axes extending lengthwise of their extension portions 12. Furthermore, the two pairs of cam plates are mounted so as to be interleaved so that, as shown most clearly in FIGS. 6 and 7, the two signal cam plates 20 lie side-by-side in parallel spaced relationship to the two lockout cam plates 10 which likewise lie side-by-side. It will be appreciated that by pulling on the pullwire or pullrod on either side of the pullkey the respective cam member 27A or 27B comprising a signal cam plate 20 and lockout cam plate 10 will be longitudinally displaced with a linear sliding movement relative to the other cam member.

Figure 4:
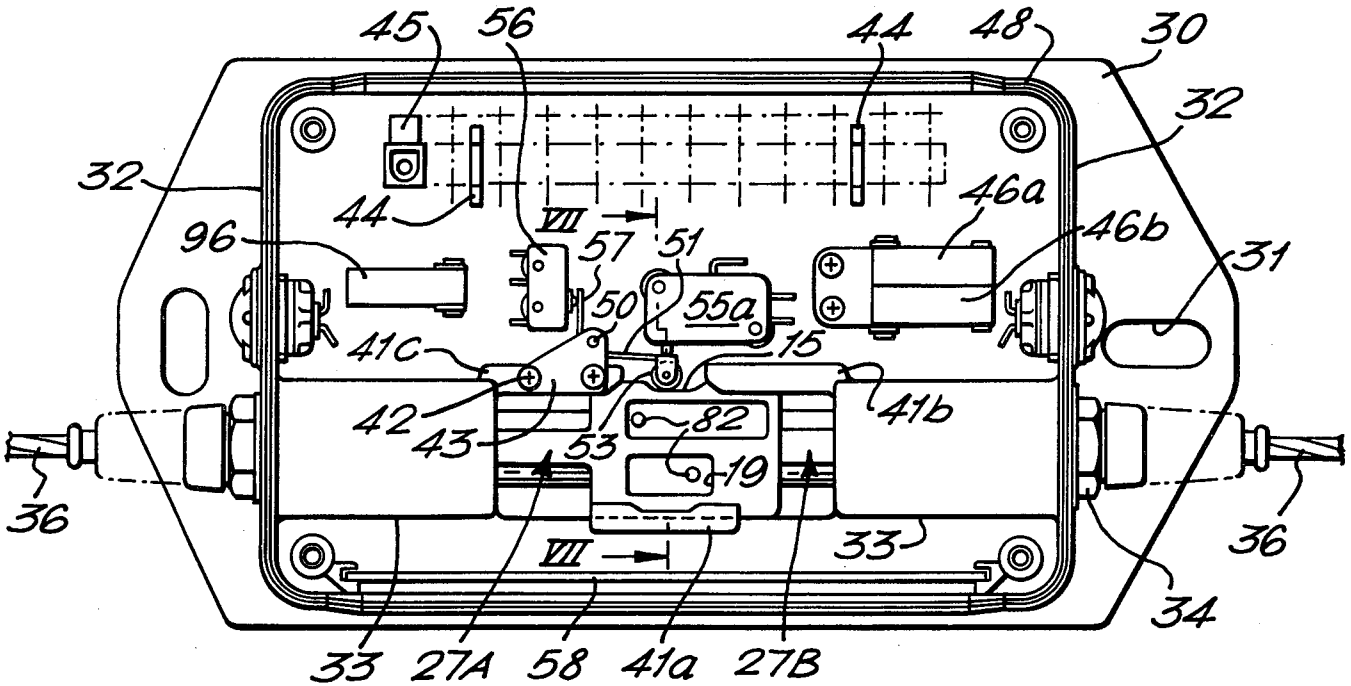
FIG. 4 is a front elevation of a first embodiment of latching pullkey in accordance with the invention, using cam members as shown in FIG. 3, with certain parts indicated schematically and with other parts, such as the front cover, omitted for greater clarity.

Referring now particularly to FIGS. 4 and 6, it will be seen that the pullkey comprises a base which is indicated generally at 30 and which is subtantially rectangular in front elevation. The base 30 is provided at each end with a wing portion which is provided with a slot 31 for receiving a bolt (not shown) by means of which the pullkey can be secured to a mounting surface. The base 30 is preferably a pressure die casting which houses the mechanism of the pullkey. The precision which can be achieved with a casting eliminates virtually all machining. Preferably, the base 30 is made of a zinc alloy material. The base 30 has upstanding walls 32 at each end. Extending inwardly from each wall 32 is a tunnel portion 33 through which cable entry is achieved through a brass retaining nut 34 which is a screwfit within a cable entry hole. A protective boot 35 extends between the nut 34 and the cable 36 which terminates in an eyelet 37 to which the pull wire is connected. The inner end of the cable 36 is encircled by a brass sleeve 38 and is silver soldered to it. A compression spring 39 is housed within each tunnel portion 33. This spring 39 is seated at its outer end against the internal surface of the upstanding base side wall 32, and is seated at its other end against a tension pin 40 which extends through the extension portions of the cam member and which therefore compresses the spring as the cam member is pulled outwards. The spring 39 provides a longitudinally inward thrust against the cam member 27A, 27B, so that any pull exerted on the pullwire or pull rod is exerted against the force of this spring.

The base 30 is provided between the two tunnel sections 33 with a guideway for the cam members 27A, 27B. This guideway is formed, as shown in FIG. 4, by three upstanding webs 41*a*, 41*b* and 41*c*, each of which is turned over at the top to define a retaining flange beneath which the cam members are retained in place and beneath which the cam members are able to slide in a guided manner without tilting. The guide web 41*c* carries two socket posts which are provided with screw-threaded holes to receive fastening screws 42 to hold a mounting plate 43.

As can also be seen from FIG. 4, the base 30 is provided with two ribs 44 which are used to retain a 12-way electrical terminal block 45 as a push fit thereon. This mounting enables the terminal block 45 to be removed easily for servicing. Also within the base 30 there is provided a further rib which is arranged to carry two microswitches 46*a*, 46*b* which are used for test purposes. These microswitches are mounted on a plate secured by screws to the projecting rib so that the microswitches are pivotable when pressed down towards the base 30. They are positioned below a 'test' socket 47 (FIG. 5) on the front of the pullkey. It will also be noted from FIGS. 4 and 6 that the upstanding marginal wall of the base is provided around its periphery with a tongue which is adapted to seat within a corresponding groove in the front cover of the pullkey. A resilient plastics sealing ring 48 is provided between the tongue and groove to ensure an effective sealing joint.

Figure 7:
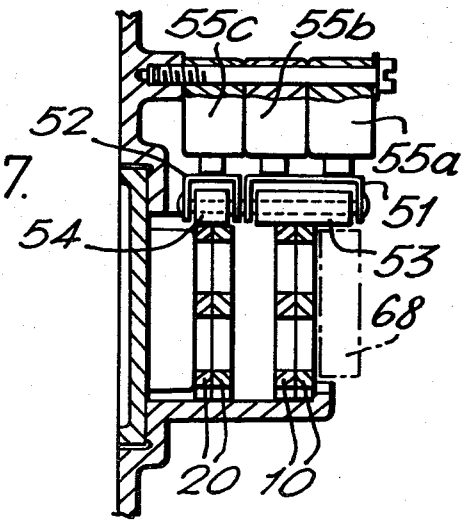
FIG. 7 is a sectional view through a part of the pullkey, taken along the line VII—VII in FIG. 4.

Reference was made above to the fact that one of the three guides 41*c* for the cam members also serves to hold a mounting plate 43. As will be seen from FIGS. 4 and 7, this mounting plate 43 is provided with a third hole through which extends a pin 50 which is seated at its other end in the base 30. Mounted on this pin 50 are two plates, one of which is visible at 51 in FIG. 4 and the other of which is shown at 52 in FIG. 7. Each plate 51, 52 has a pair of downturned flanges at the end remote from the pin 50. Between the flanges of plate 51 a cam follower roller 53 is rotatably mounted. Between the flanges of plate 52 a cam follower roller 54 is rotatably mounted. Roller 53 is approximately three times the length of roller 54. These rollers 53 and 54 are positioned so that they rest on the top edges of the respective cam plates of the cam members. As will be seen from FIG. 4, the cam follower rollers 53,54 normally rest within the recesses 15 and 21 in the upper edges of the lockout cam plates 10 and signal cam plates 20. Mounted adjacent the cam followers remote from the sliding cam members 27A, 27B are three microswitches 55*a*, 55*b*, 55*c* (FIG. 7). Suitable microswitches are those known as Burgess V3 Series switches. These microswitches are arranged side-by-side in a stack. The actuating elements of the switches 55*a* and 55*b* are in contact with plate 51 which carries roller 53. The actuating element of switch 55*c* is in contact with plate 52 which carries roller 54. The relatively narrow cam follower roller 54 is associated with the recesses 21 in the two signal cam plates 20 and the associated microswitch 55*c* thus functions as a signal microswitch. The longer cam follower roller 53 rests within the recesses 15 in the upper edges of the lockout cam plates 10, and the two microswitches 55*a* and 55*b* associated therewith therefore function as lockout microswitches. The three microswitches are connected by suitable leads to the terminal block 45. The mechanism is also such that it gives a "quick make-slow break" action, which is the most efficient sequence for alternating current working. From the description of the pullkey given so far, it will be readily appreciated that a pull on the pullwire or pullrod on either side of the pullkey will cause the respective linear cam member to be displaced longitudinally relative to the other cam member. This will cause one each of the signal cam plates and lockout cam plates to move longitudinally, thus causing the cam follower rollers 54 and 53 to ride up out of the recesses 21 and 15 towards or on to the top edges of the cam plates. This causes the microswitches to be triggered. It will also be appreciated that the two cam members are identical, so that equivalent operation is achieved from either side of the pullkey. As mentioned above, the length of the recesses 15 and 21 in the lockout cam plates and signal cam plates 10 and 20 respectively need not be the same. For example, in the illustrated embodiment, the microswitches producing lockout are triggered after a linear cam movement of 12.5 mm, whereas the microswitch producing the signal output is triggered after a linear cam movement of 13.5 mm. If all the recesses are the same size, then the lockout microswitches 55*a*, 55*b* and the signal microswitch 55*c* will be actuated simultaneously. The signal to lockout sequence can be changed simply by making the lockout cam plate recesses 15 longer or shorter than the signal cam plate recesses 21. Thus, although the signal to lockout sequence will be predetermined by the dimensions of the recesses, one can also design the mechanism for lockout before signal, or for lockout after signal. Any input to the pullkey, i.e. pull on the wire, will always operate both cam followers and produce both signal and lockout outputs. The three microswitches can easily be removed and replaced without disturbing the actuators, i.e. the cam follower mechanism. No adjustment is necessary either on assembly or when changing the microswitches in service. With full travel of the pullwire or pullrod the main compression springs 39 will not "go solid". The cam members 27A, 27B are arranged to contact the end faces of the retaining nut 34 of the base before the compression springs 39 are fully compressed. This means that the springs 39 are not damaged, and means that their life is extended. As indicated in FIG. 4, optional auxiliary microswitches 56 may be provided adjacent to the mounting plate 43 and actuated by arms 57 pivotable about pin 50 conjointly with movement of the cam follower plates 51 and 52. An optional printed circuit board is indicated at 58.

Figure 5:
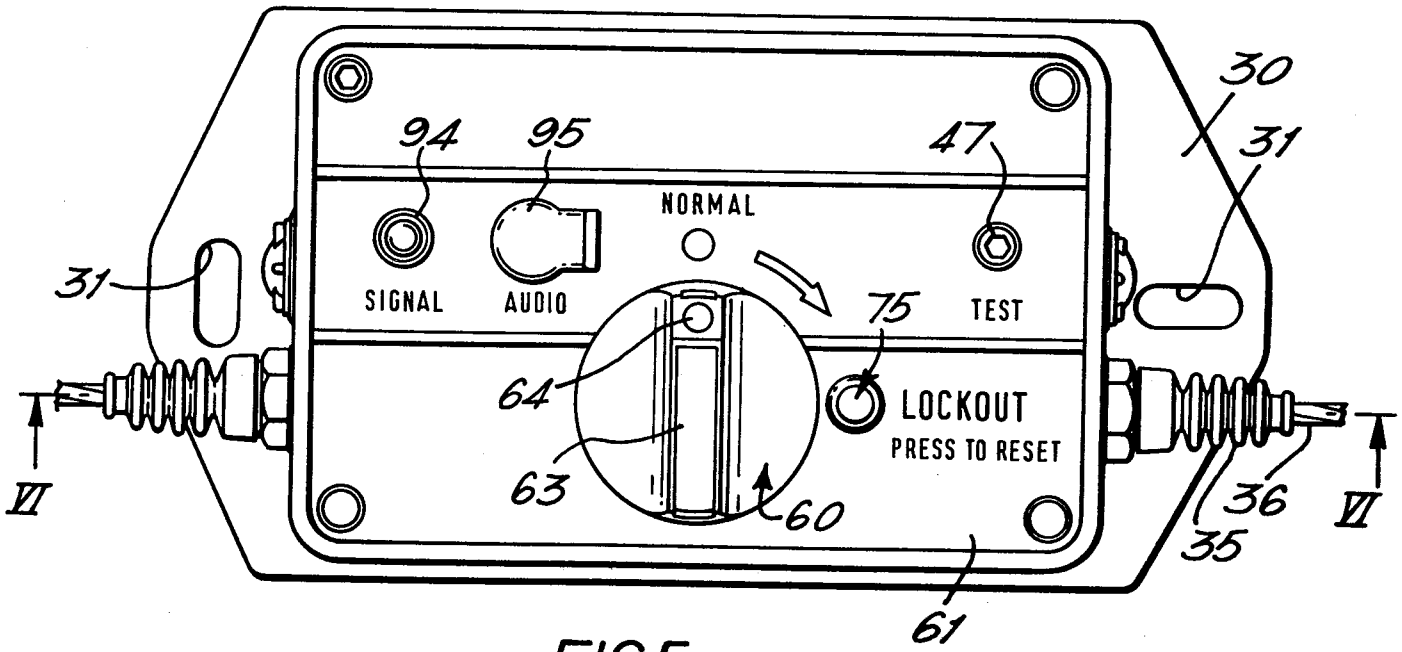
FIG. 5 is a front elevation of the pullkey of FIG. 4 with the front cover in place.

The pullkey of the present invention also includes a lockout knob. This lockout knob is indicated generally at 60 and can be made for example of an acetal copolymer material. The lockout knob enables a person to initiate lockout locally by turning the knob 60 on the pullkey. This is achieved by the lockout knob operating the lockout microswitches 55*a* and 55*b* directly. As shown in FIGS. 5 and 6, the lockout knob 60 fits flush with the front cover 61 of the pullkey to prevent any build-up of dust, grit, etcetera. The lockout knob comprises a circular plate 62 with an outwardly projecting rib 63 extending diametrally across the plate. One end of the rib 63 is provided with an indicator marking 64. Reflectors, such as LEDs, can be incorporated into the ends of the rib 63 for identification of lockout. Alternatively, to provide a visible indication of lockout, one could use edge lighting through the moulding from an internal light source. The plate 62 is fitted into a recessed portion 65 of the front cover 61. A collar 66 extends inwardly from the centre of the recessed portion 65. A peripheral sealing ring is provided between plate 62 and the front cover. The inner face of the plate 62 is provided with an annular spigot 67 which extends into the collar 66. A rotary lockout knob cam 68 also extends into the collar 66 to engage spigot 67. An O-ring seal 69 is provided between the cam 68 and the spigot 67. The lockout knob spigot 67 and the lockout knob cam 68 have matching cross-sections to ensure joint rotary movement and are secured together by a central socket-ended bolt 70 which extends from the inside of the cam 68. The lockout knob cam 68 has a projecting cam portion 71 as a radial extension of the cam plate. On the face of cam portion 71 adjacent tO the front cover there is provided a stud 72 (FIG. 9) which lies radially outwardly of the collar 66. The collar 66 is provided with two radially outwardly extending stop ribs 73 (FIG. 8) between which the stud 72 can move and which therefore limit the rotation of the stud, and hence of the cam 68 and lockout knob, to 90°. The shape of the projecting cam portion 71 is such that manual rotation of the lockout knob 60 from the normal position as shown in FIG. 5 in the clockwise direction will cause rotation of the cam 68 such that the projecting cam portion 71 will engage that portion of the longer cam follower roller 53 which projects laterally of the interleaved lockout cam plates 10, as indicated in FIG. 7. This causes the cam follower roller 53 to be raised to trigger the lockout microswitches. This electrical lockout preferably occurs after about 70° rotation of the lockout knob 60.

It will be appreciated that the lockout knob 60 is fitted into the recessed portion 65 of the front cover 61. The front cover 61 is also provided with a small hole 74 to one side of the lockout knob. Associated with this small hole 74 is reset button 75 (FIG. 6). The reset button 75 comprises a first finger 77 which is seated within the hole 74 in the front cover, and a second, shorter and thinner finger 78 which extends through a hole 79 in the front cover and which has its projecting tip abutting a rib on the inside face of the plate 62 of the lockout knob. This internal face of the lockout knob plate 62 is provided with a recess at a radial distance from the centre of the knob such that it is aligned with the projecting finger 78 of the reset button. The flange portion of the reset button connecting the two fingers is provided on the side opposite the two fingers with a projecting spigot 80 and the reset button 75 is mounted so that it is permanently subjected to the force of a spring 81 urging the button outwards towards the front of the pullkey. When the lockout knob 60 is positioned as shown in FIG. 5 the projecting finger 78 of the reset button is in contact with the smooth inner face of the lockout knob plate 62 and the longer finger 77 of the reset button lies wholly within the hole 74. However, when the lockout knob 60 is rotated to the position where the cam portion 71 triggers the lockout microswitches, the projecting finger 78 simultaneously drops into the recess in the lockout knob plate 62 and the other projecting finger 77 then projects proud of the surface of the front cover. When this lockout mechanism has been actuated it is necessary to press in the projecting finger 77 of the reset button before the lockout knob 60 can be turned back to its normal position. This lockout mechanism is a positive mechanism and will not reset inadvertently due to vibration, accidental knocks, misuse, etcetera. A deliberate manual resetting action is required.

It will be seen from FIGS. 4, 6 and 8 that the lockout knob cam 68 has two pins 82 extending from the lockout knob into the holes 17*a* and 17*b* respectively formed through the two lockout cam plates 10. These projecting pins 82 are set 180° apart within the external contour of the rotary cam 68. The projecting pins 82 are positioned on the lockout knob cam 68 so that they are engaged respectively by the abutment surfaces 19 of the lockout cam plates 10 as these are displaced longitudinally. In other words, a longitudinal movement of either one of the lockout cam plates 10 will cause the internal abutment surface 19 within the cam plate to strike one of the projecting pins 82 and thus rotate the lockout knob, and cause the lockout button 75 to be actuated. In other words, a mechanical latching is effected. Although operation of the pullwire or pullrods in this way rotates the lockout knob to its "locked out" position, the cam members 27A, 27B are still able to slide back to their starting positions. This means that even after the lockout knob 60 has been "locked out", the linear cam members 27A, 27B can be displaced again by pulling the pullwire in order to produce a signal output via the appropriate microswitch 55*c*. This illustrated embodiment, incorporating the pins 82 on the lockout knob, thus constitutes a latching pullkey. With the latching pullkey a pull on the wire will cause the lockout knob to be actuated automatically, and a positive resetting of the mechanism is necessary at the local pullkey which has been triggered.

In an alternative embodiment of the invention, the pullkey may be constructed as a non-latching pullkey. In this case the two pins 82 on the lockout knob are removed. This means that the sliding cam members can be displaced via the pullwire or pullrods without causing the locking knob to be turned. With this arrangement one does not need to carry out local resetting of the pullkey; resetting can be carried out from a remote location. One has local actuation of the lockout knob only, i.e. a person has actually to rotate the knob manually in order to inhibit resetting.

Referring to FIG. 6, it will be seen that the front cover 61 of the pullkey is provided with a peripheral groove for co-operative sealing engagement with the corresponding tongue on the base walls 32. The front cover 61 may be a pressure die casting or an injection moulding. The notched joint profile is chosen to give maximum access for incoming connections. The provision of a tapered notch assists the eye in aligning the cover when it is being fitted.

One of the advantages of the pullkey of the present invention is that it incorporates a positive lockout mechanism, which can be operated both manually and remotely. The internal components are fully accessible for ease of testing and servicing. The pullkey incorporates a direct on-line switching action. The pullkey can also be produced in either a latching or non-latching version with only minimum structural differences.

The pullkey hereinbefore described can also readily be adapted for use with a taut wire system. The necessary modification is shown in FIG. 10. Here, in addition to the compression spring 39, a supplementary return spring 92 is provided and suitable clearance slots are machined in the base and backplate to enable the cam member to operate on the back stroke. A setting mark 93 is provided on the shackle wire for initial setting up of the pullkey within the taut wire system. In this taut wire system it is desirable to provide a visible indication in the event of a break in the cable. The front of the cover is therefore provided with a "cable break" marker adjacent to the lockout knob and diametrally opposite the reset button. The lockout knob is provided with an arrowhead indicator at 45° angle of rotation from the cable breaker pointer. In the event of the cable breaking, the springs 39 and 92 are so designed that the cam members will move through a distance equivalent to a 45° rotation of the lockout knob.

As will be seen from FIG. 5, the pullkey also includes the usual signal button 94 for providing a local signal, and a sealed audio socket 95 for providing a communication facility. A pivotable microswitch 96 is provided on the base 30 beneath the signal button to be contacted thereby.

I claim:

1. A switch mechanism comprising first switch means, second switch means, two cam members which are slidable linearly relative to each other in side-by-side relationship and which each have first and second cam surfaces, a first cam follower engageable by said two first cam surfaces and displaceable upon relative sliding movement of the cam members to actuate said first switch means, and a second cam follower engageable by said two second cam surfaces and displaceable independently of said first cam follower upon the said relative sliding movement of the cam members to actuate said second switch means, wherein actuation of said first switch means to generate a first output response does not prevent repeated actuation of said second switch means by said second cam surfaces in response to repeated relative sliding movement of the cam members.

2. A switch mechanism according to claim 1, in which the cam members each comprise first and second parallel cam plates with for each cam plate said first plate defining one of said first cam surfaces and the second plate defining one of said second cam surfaces, the four plates being interleaved so that said first plates are positioned adjacent to each other and said second plates are positioned adjacent to each other.

3. A switch mechanism according to claim 1, in which the first and second cam surfaces are defined by recessed zones in the peripheral edges of the cam members, and said cam followers comprise rollers cooperable with said recessed zones and pivotable in response to said relative sliding movement of the cam members.

4. A switch mechanism according to claim 3, in which the two cam members are identical.

5. A switch mechanism according to claim 3, in which the recessed zones which define said first cam surfaces are not the same length as the recessed zones which define said second cam surfaces, whereby an output response from said second switch means is obtained at a different time from the output response from said first switch means.

6. A switch mechanism comprising first switch means arranged to initiate a first output response, a second switch means arranged to initiate a second output response, first and second cam members mounted for linear relative sliding movement, each cam member defining a first cam surface which controls actuation of said first switch means and a second cam surface which controls actuation of said second switch means, and a manually controllable actuator capable of actuation of said first switch means independently of the movement of said cam members without inhibiting subsequent relative sliding movement of the cam members.

7. A switch mechanism according to claim 6, in which said manually controllable actuator comprises a rotary cam.

8. A switch mechanism according to claim 7, in which said rotary cam acts on said first switch means through a cam follower which is also engaged by said two first cam surfaces.

9. A switch mechanism according to claim 6 in which the cam members each comprise first and second parallel cam plates with for each cam member said first plate defining one of said first cam surfaces and the second plate defining one of said second cam surfaces, the four plates being interleaved so that said first plates are positioned adjacent to each other and adjacent to the manually controllable actuator and said second plates are positioned adjacent to each other.

10. A switch mechanism according to claim 6, in which each of the cam members defines a third cam surface and, upon a relative sliding movement of the cam members sufficient for one of said first cam surfaces to actuate said first switch means, a respective one of said third cam surfaces moves said manually controllable actuator to a position in which it can only be reset manually.

11. A switch mechanism according to claim 10, in which each of the linear cam members is a hollow cam with the first and second cam surfaces formed in the external contour and with the third cam surface formed by the internal contour.

12. A switch mechanism according to claim 11, in which each cam member comprises first and second substantially rectangular plates, the first plate of each pair having a rectangular hole therethrough and the second plate of each pair having a generally L-shaped hole therethrough with said third cam surface defined by the inwardly projecting corner of the L-shaped hole.

13. A switch mechanism according to claim 11 in which each cam member comprises first and second substantially rectangular plates, the first plate of each pair having two rectangular holes of equal length therethrough positioned side-by-side, and the second plate of each pair having two rectangular holes of different lengths therethrough positioned side-by-side, with said third cam surface defined by the surface at one end of the shorter length hole of said last mentioned holes.

14. A pullkey comprising a housing, entry means at opposite ends of the housing to receive ends of pullwires or pullrods, and a switch mechanism mounted within said housing, said switch mechanism comprising first switch means arranged to initiate a first output response, a second switch means arranged to initiate a second output response, first and second cam members mounted for linear relative sliding movement, each cam member defining a first cam surface which controls actuation of said first switch means and a second cam surface which controls actuation of said second switch means, and a manually controllable actuator capable of actuating said first switch means independently of the movement of said cam members without inhibiting subsequent relative sliding movement of the cam members, wherein said first output response is lockout, said second output response is a signal, and said manually controllable actuator comprises a lockout knob.

15. A pullkey according to claim 14, in which the pullkey is a latching pullkey, the lockout knob being provided with one or more pins projecting into a path of movement of the cam members whereby sliding movement of one of the cam members causes automatic rotation of the knob to a latched position.

16. A pullkey according to claim 15, in which the lockout knob is coupled to a rotary cam which is rotatable to actuate the first switch means, wherein the cam actuates said first switch means to initiate lockout electrically before it rotates sufficiently to cause said automatic mechanical latching of the knob.

17. A pullkey according to claim 14, in which said first and second switch means comprise microswitches stacked adjacent to said cam members, direct coupling between the microswitches and the first and second cam surfaces respectively being obtained through independently movable first and second cam follower rollers engaged by said first and second cam surfaces respectively.

18. A pullkey according to claim 14, in which said lockout knob is mounted recessed into a front cover of the housing and has a spigot projecting into the housing and coupled for joint rotation with a rotary cam which is arranged to actuate said first switch means, said rotary cam being provided with a stop which is engageable with two abutments internally of the housing to limit rotation of the knob to 90°.

19. A pullkey according to claim 14, in which the cam members each comprise first and second parallel cam plates with for each cam plate the first plate defining one of said first cam surfaces and the second plate defining one of said second cam surfaces, the four plates being interleaved so that said first plates are positioned adjacent to each other and adjacent to the manually controlled actuator and said second plates are positioned adjacent to each other.

20. A pullkey according to claim 14, in which each of the cam members defines a third cam surface and, upon a relative sliding movement of the cam members sufficient for one of said first cam surfaces to actuate said first switch means, a respective one of said third cam surfaces moves said manually controllable actuator to a position in which it can only be reset manually.

21. A pullkey according to claim 20, in which each of the linear cam members is a hollow cam with the first and second cam surfaces formed in the external contour and with the third cam surface formed by the internal contour.

* * * * *